US010822977B2

(12) United States Patent
Wang et al.

(10) Patent No.: US 10,822,977 B2
(45) Date of Patent: Nov. 3, 2020

(54) GUIDE VANE ASSEMBLY FOR A ROTARY MACHINE AND METHODS OF ASSEMBLING THE SAME

(71) Applicant: General Electric Company, Schenectady, NY (US)

(72) Inventors: Yu Wang, Schenectady, NY (US); Sean Morrissey, Schenectady, NY (US); Xiaoqing Zheng, Niskayuna, NY (US); Tao Guo, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 559 days.

(21) Appl. No.: 15/365,464

(22) Filed: Nov. 30, 2016

(65) Prior Publication Data

US 2018/0149022 A1 May 31, 2018

(51) Int. Cl.

| | |
|---|---|
| ***F01D 11/00*** | (2006.01) |
| ***F01D 11/02*** | (2006.01) |
| ***F01D 5/02*** | (2006.01) |

(52) U.S. Cl.

CPC ..... *F01D 11/001* (2013.01); *F01D 5/02* (2013.01); *F01D 11/02* (2013.01); *F05D 2240/126* (2013.01); *F05D 2240/127* (2013.01); *F05D 2240/129* (2013.01); *F05D 2260/97* (2013.01)

(58) Field of Classification Search

CPC ..... F04D 29/124; F01D 11/001; F01D 11/02; F01D 11/04; F01D 11/08; F05D 2220/31; F05D 2240/126; F05D 2240/129; F05D 2260/97; F05D 2230/60; F05D 2240/127

USPC ..... 415/173.7, 174.5

See application file for complete search history.

(56) References Cited

U.S. PATENT DOCUMENTS

| | | | | |
|---|---|---|---|---|
| 881,474 | A | 3/1908 | Jude et al. | |
| 1,819,864 | A * | 8/1931 | Bloomberg | F01D 5/081 415/168.4 |
| 4,274,065 | A * | 6/1981 | Garscadden | H01S 3/0979 372/58 |
| 6,736,597 | B2 | 5/2004 | Uehara et al. | |
| 8,596,973 | B2 | 12/2013 | Grondahl | |
| 9,394,800 | B2 * | 7/2016 | Zheng | F01D 11/04 |
| 2005/0104300 | A1 | 5/2005 | Hogg et al. | |
| 2005/0194745 | A1 | 9/2005 | Hogg | |

(Continued)

FOREIGN PATENT DOCUMENTS

| | | |
|---|---|---|
| EP | 1734230 A1 | 12/2006 |
| EP | 2236868 A1 | 10/2010 |

(Continued)

OTHER PUBLICATIONS

Extended European Search Report and Opinion issued in connection with corresponding EP Application No. 17203249.2 dated Mar. 29, 2018.

*Primary Examiner* — Richard A Edgar
*Assistant Examiner* — Maranatha Boardman
(74) *Attorney, Agent, or Firm* — Armstrong Teasdale LLP

(57) ABSTRACT

A blade includes an airfoil, a stationary portion coupled to a radially inner end of the airfoil, and a leakage flow guide vane assembly coupled to the stationary portion. The leakage flow guide vane assembly includes a plurality of passages defined therein. The passages are oriented to induce a swirl velocity to a working fluid flowing through the passages.

11 Claims, 8 Drawing Sheets

(56) References Cited

U.S. PATENT DOCUMENTS

| | | | | |
|---|---|---|---|---|
| 2008/0056895 | A1* | 3/2008 | Senoo | F01D 5/143 415/199.4 |
| 2011/0135454 | A1 | 6/2011 | Grondahl | |
| 2012/0163955 | A1* | 6/2012 | Devi | F01D 11/02 415/1 |
| 2013/0183150 | A1 | 7/2013 | Batt | |
| 2014/0205444 | A1 | 7/2014 | Zheng et al. | |
| 2016/0123169 | A1 | 5/2016 | Ruggiero et al. | |
| 2016/0326879 | A1 | 11/2016 | Chouhan et al. | |

FOREIGN PATENT DOCUMENTS

| | | | |
|---|---|---|---|
| EP | 2415969 | A1 | 2/2012 |
| EP | 2564032 | A1 | 3/2013 |
| EP | 2236868 | B1 | 10/2013 |
| EP | 2564032 | B1 | 5/2016 |
| EP | 3 034 784 | A1 | 6/2016 |
| JP | S59-122707 | A | 7/1984 |
| WO | 2012016790 | A1 | 2/2012 |
| WO | 2016/096420 | A1 | 6/2016 |
| WO | 2016/121259 | A1 | 8/2016 |

* cited by examiner

GUIDE VANE ASSEMBLY FOR A ROTARY MACHINE AND METHODS OF ASSEMBLING THE SAME

BACKGROUND

The field of the disclosure relates generally to rotary machines, and, more particularly, to a leakage flow guide vane assembly use with a rotary machine.

At least some known rotary machines, including, but not limited to, some known steam turbines, channel a working fluid from a fluid source through a housing inlet and along an annular steam path. Typically, turbine stages are positioned within the primary fluid path such that the working fluid flows through fixed blades and rotary vanes of subsequent turbine stages. Axial gaps defined between the stationary and rotating components facilitate rotation of the rotating components.

In at least some known rotary machines, the high pressure working fluid in the primary fluid path may leak into the axial gaps and be channeled downstream and expelled back into the primary fluid path. However, because the working fluid in the primary fluid path is deflected by the stationary and rotating components, the leakage flow of working fluid enters the primary fluid path at a different angle, or tangential velocity, than the working fluid flowing in the primary fluid path. As such, the leakage flow may impact the downstream rotating components at a greater angle of incidence than the working fluid in the primary fluid path, thereby creating efficiency losses in the rotary machine. Over time, such losses may increase operating expenses and fuel costs.

BRIEF DESCRIPTION

In one aspect, a blade is provided. The blade includes an airfoil, a stationary portion coupled to a radially inner end of the airfoil, and a leakage flow guide vane assembly coupled to the stationary portion. The leakage flow guide vane assembly includes a plurality of passages defined therein. The plurality of passages are oriented to induce a swirl velocity to a working fluid flowing through the passages.

In another aspect, a rotary machine is provided. The rotary machine includes a rotor, and a blade that extends circumferentially about the rotor. The blades includes an airfoil, a stationary portion coupled to a radially inner end of the airfoil and defining a leakage flow path between the stationary portion and the rotor, and a leakage flow guide vane assembly coupled to the stationary portion and located in the leakage flow path. The leakage flow guide vane assembly includes a plurality of passages defined therein. The plurality of passages are oriented to induce a swirl velocity to a working fluid flowing through the passages.

In another aspect, a method of assembling a rotary machine is provided. The method includes coupling a blade to a diaphragm of a casing of the rotary machine and coupling a rotor to the casing. The rotor includes at least one turbine stage located adjacent to and downstream from a blade. Moreover, the method includes forming a primary flow path within the casing and in flow communication with an inlet of the casing. The method further includes coupling a leakage flow guide vane assembly to the blade adjacent the at least one turbine stage. The leakage flow guide vane assembly is positioned in a leakage flow path defined between the rotor and the blade, for inducing a swirl velocity in a working fluid passing through the leakage flow path.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

The embodiments described herein include a fixed blade or nozzle of a rotary machine including a leakage flow guide vane assembly coupled to a casing of the rotary machine. More specifically, the fixed blades or nozzles include a plurality of guide vanes or guide slots that induce a tangential or swirl velocity to a steam leakage flow that is substantially similar to the tangential or swirl velocity of the flow of steam in a primary flow path. The guide vanes or slots are coupled to a downstream portion of the fixed blade or nozzle, and are oriented at a predetermined angle with respect to the leakage flow to induce the tangential or swirl velocity. The guide vanes or slots may be coupled to or formed integrally with the fixed blades. As a result, when the steam leakage flow is channeled back into the primary flow path, the angle of incidence of the leakage flow is substantially similar to that of the primary steam flow at a leading edge of the rotor blades.

Unless otherwise indicated, approximating language, such as "generally," "substantially," and "about," as used herein indicates that the term so modified may apply to only an approximate degree, as would be recognized by one of ordinary skill in the art, rather than to an absolute or perfect degree. Approximating language may be applied to modify any quantitative representation that could permissibly vary without resulting in a change in the basic function to which it is related. Accordingly, a value modified by a term or terms, such as "about," "approximately," and "substantially," is not to be limited to the precise value specified. In at least some instances, the approximating language may correspond to the precision of an instrument for measuring the value. Here and throughout the specification and claims, range limitations are identified. Such ranges may be combined and/or interchanged, and include all the sub-ranges contained therein unless context or language indicates otherwise.

Additionally, unless otherwise indicated, the terms "first," "second," etc. are used herein merely as labels, and are not intended to impose ordinal, positional, or hierarchical requirements on the items to which these terms refer. Moreover, reference to, for example, a "second" item does not require or preclude the existence of, for example, a "first" or lower-numbered item or a "third" or higher-numbered item.

Figure 1:
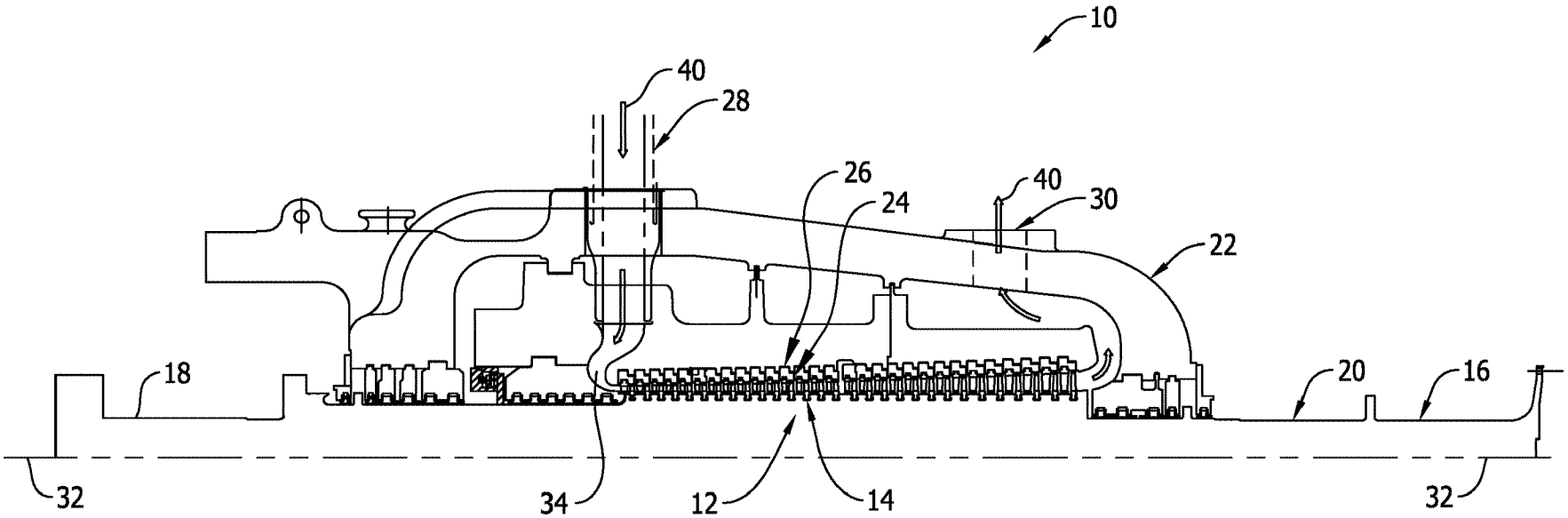
FIG. 1 is a schematic view of an exemplary rotary machine.

FIG. 1 is a schematic view of an exemplary rotary machine 10. It should be noted that the apparatus, systems, and methods described herein are not limited to any one particular type of rotary machine. One of ordinary skill in the art will appreciate that the apparatus, systems, and methods described herein may be used with any rotary machine, including for example, and without limitation, a steam turbine or a gas turbine engine, in any suitable configuration that enables such apparatus, systems, and methods to operate as further described herein.

In the exemplary embodiment, rotary machine 10 is a single-flow steam turbine. Alternatively, rotary machine 10 is any type of steam turbine, for example, and without limitation, a low-pressure steam turbine, an opposed-flow high-pressure and intermediate-pressure steam turbine combination, or a double-flow steam turbine. Moreover, as discussed above, the present disclosure is not limited to only being used in steam turbines, but can be used in other turbine systems, such as gas turbine engines.

In the exemplary embodiment, rotary machine 10 includes a plurality of turbine stages 12. Each turbine stage 12 includes a plurality of circumferentially-spaced rotor blades 14 coupled to a rotor 16. It should be noted that, as used herein, the term "couple" is not limited to a direct mechanical, electrical, and/or communication connection between components, but may also include an indirect mechanical, electrical, and/or communication connection between multiple components. Rotor blades 14 extend radially outward from rotor 16. The plurality of rotor blades 14 may include any suitable number of rotor blades 14 that enables rotary machine 10 to operate as described herein. Rotor 16 is supported at opposing end portions 18 and 20 of rotor 16 by bearings (not shown).

A casing 22 surrounds the plurality of turbine stages 12. A plurality of diaphragms 24 are coupled to casing 22, such that each respective diaphragm 24 is upstream from each respective turbine stage 12. Each diaphragm 24 includes a plurality of circumferentially-spaced fixed blades 26 (i.e., nozzles). Fixed blades 26 are generally airfoil-shaped and extend radially inward from casing 22. Rotary machine 10 also includes a high pressure (HP) steam inlet 28 and a low pressure (LP) steam exhaust 30. Rotor 16 is rotatable about a centerline axis 32.

During operation, high-pressure and high-temperature steam 40 is channeled from a steam source, such as a boiler (not shown), through HP steam inlet 28 into an inlet 34. From inlet 28, steam 40 is channeled downstream through casing 22, where it encounters turbine stages 12. As steam 40 impacts rotor blades 14, it induces rotation to rotor 16 about centerline axis 32. Thus, thermal energy of steam 40 is converted to mechanical rotational energy by turbine stages 12. Steam 40 exits casing 22 at LP steam exhaust 30. Steam 40 is then channeled to the boiler, where it is reheated, and/or to other components of the system, for example, a low pressure turbine section or a condenser (not shown).

Figure 2:
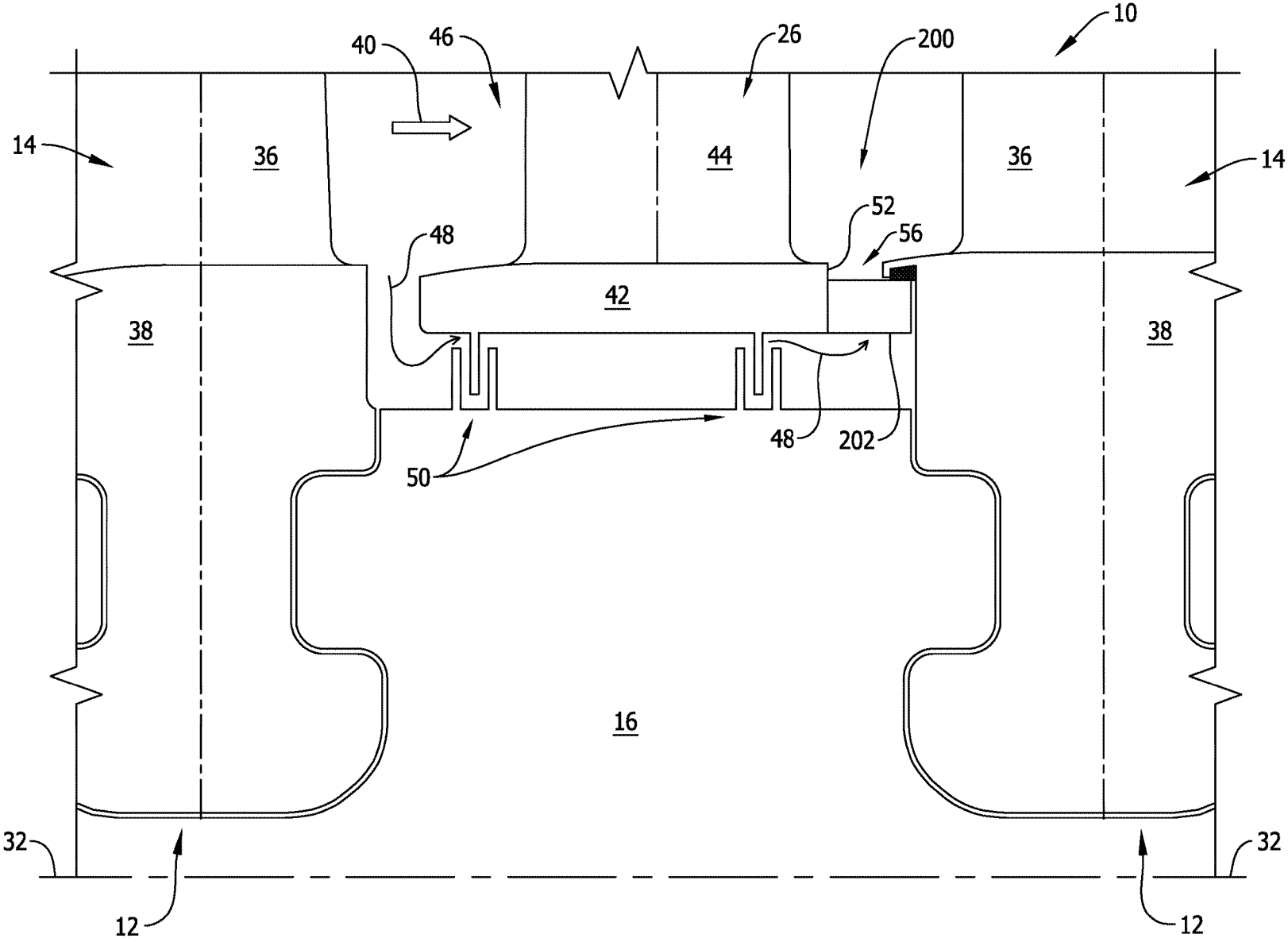
FIG. 2 is a schematic sectional view of an exemplary radial leakage flow guide vane assembly coupled to a fixed blade of the rotary machine shown in FIG. 1.
Figure 3:
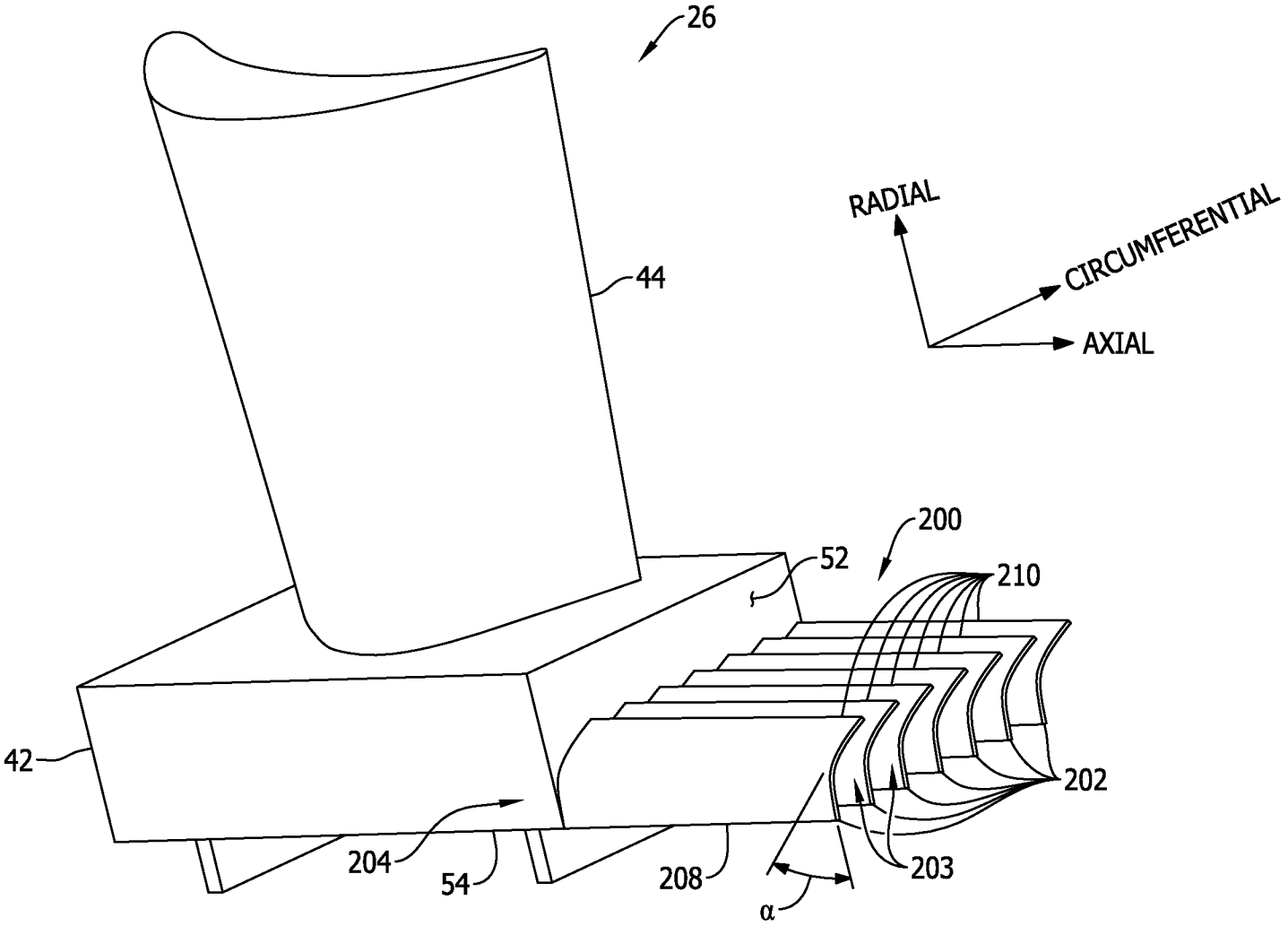
FIG. 3 is a schematic perspective view of the fixed blade shown in FIG. 2, and including the radial leakage flow guide vane assembly.

FIG. 2 is a schematic sectional view of an exemplary radial leakage flow guide vane assembly 200 coupled to fixed blades 26. FIG. 3 is a schematic perspective view of a fixed blade 26 including radial leakage flow guide vane assembly 200. In the exemplary embodiment, each rotor blade 14 includes an airfoil 36 and a root 38. Each root 38 is coupled to rotor 16 in any suitable fashion, such that rotor blades 14 rotate with rotor 16. Furthermore, rotary machine 10 includes a stationary portion 42 that extends circumferentially about rotor 16. For example, but not by way of limitation, in the exemplary embodiment, stationary portion 42 is an inner ring of diaphragm 24 coupled to a radially inner end of an airfoil 44 of each fixed blade 26 in any suitable fashion, such that stationary portion 42 remains stationary with respect to rotor 16.

Rotor blade airfoils 36 and fixed blade airfoils 44 are positioned within a primary flow path 46 of steam 40. In addition, a leakage flow path 48 is defined generally between stationary portion 42 and rotor 16. In the exemplary embodiment, a seal assembly 50 is between and/or is coupled to rotor 16 between stationary portion 42 and rotor 16. In the exemplary embodiment, seal assembly 50 is a labyrinth seal. Alternatively, seal assembly 50 may be any type of seal assembly that enables rotary machine 10 to operate as described herein, such as, for example, and without limitation, an abradable seal assembly.

In the exemplary embodiment, radial leakage flow guide vane assembly 200 includes a plurality of guide vanes 202 that extend substantially axially along centerline axis 32 of rotary machine 10 and that define a plurality of passages 203 therebetween. In particular, each guide vane 202 extends from a first end 204 to an opposite free second end 206. First end 204 is coupled to a downstream end 52 of stationary portion 42. Guide vanes 202 are coupled to stationary portion 42 in any suitable fashion, for example, and without limitation, via welding, brazing, bonding, and/or any other mechanical coupling process that facilitates coupling guide vanes 202 to stationary portion 42. Alternatively, guide vanes 202 are integrally formed with stationary portion 42, for example, via an additive manufacturing process or a machining process. In the exemplary embodiment, the plurality of guide vanes 202 are spaced circumferentially about rotor 16. In the exemplary embodiment, the plurality of fixed blades 26 are positioned circumferentially adjacent to each other such that stationary portions 42 cooperate to form a substantially continuous ring around rotor 16.

In the exemplary embodiment, each guide vane 202 is sized and shaped substantially identically. Guide vane 202 is formed as a thin plate, and has a generally rectangular cross-sectional shape. Alternatively, guide vane 202 may have a non-rectangular cross-sectional shape, such as, for example, and without limitation, an airfoil cross-sectional shape or any other cross-sectional shape that enable guide vane 202 to operate as described herein. In the exemplary embodiment, guide vane 202 includes a first portion 208 that extends generally radially outwardly a predetermined distance from a bottom surface 54 of stationary portion 42. Guide vane 202 also includes a second portion 210 that extends circumferentially with respect to first portion 208. In particular, second portion 210 extends generally circumferentially at an angle $\alpha$ with respect to first portion 208. In the exemplary embodiment, angle α has a value predetermined to ensure that steam 40 flowing through leakage flow path 48 exits leakage flow path 48 and returns to primary flow path 46 at a substantially similar tangential flow velocity as steam 40 passing through fixed blades 26.

In some embodiments, guide vanes 202 circumferentially overlap such that a first portion 208 of a respective guide vane 202 is overlapped or covered in the radial direction by a second portion 210 of an adjacent guide vane 202. In an alternative embodiment, guide vanes 202 are spaced circumferentially such that adjacent guide vanes 202 do not overlap. In the exemplary embodiment, the number of guide vanes 202 and the angle α with which the second portion 210 extends is predetermined based on specific operating parameters of rotary machine 10.

In operation, high pressure steam 40 is channeled into primary flow path 46. Steam 40 pressurizes primary flow path 46 and induces rotation of rotor 16. In particular, steam 40 has a substantial axial velocity that enables steam 40 to impact rotor blades 14 and cause rotation of rotor 16. Moreover, as steam 40 is channeled through fixed blades 26, fixed blades 26 impart a swirl velocity on the flow of steam 40. In the exemplary embodiment, the angle of rotor blade airfoil 36 and fixed blade airfoil 44 is predetermined to facilitate increasing the efficiency of rotary machine 10.

A portion of steam 40 flows from primary flow path 46 to leakage flow path 48. After leakage of steam 40 into leakage flow path 48, steam 40 is channeled towards guide vane assembly 200. Steam 40 passes through guide vane assembly 200 where it is channeled into primary flow path 46 with a swirl velocity that is substantially similar to steam 40 in primary flow path 46 and exiting each fixed blade airfoil 44. In particular, steam 40 in leakage flow path 48 enters passages 203 defined between guide vanes 202 in a generally radial direction at first portion 208. As steam 40 flows through guide vane assembly 200, it is turned in a generally circumferential direction by second portions 210 of guide vanes 202. Steam 40 in leakage flow path 48 then is channeled back to primary flow path 46 through a gap 56 defined between stationary portion 42 and root 38 of adjacent fixed blades 26 and rotor blades 14, respectively. This facilitates inducing a tangential or swirl velocity to steam 40 exiting leakage flow path 48 and increases an overall efficiency of rotary machine 10 by reducing the incidence loss of the steam leakage flow on a downstream rotor blade 14, thereby facilitating a decrease in associated fuel costs.

Figure 4:
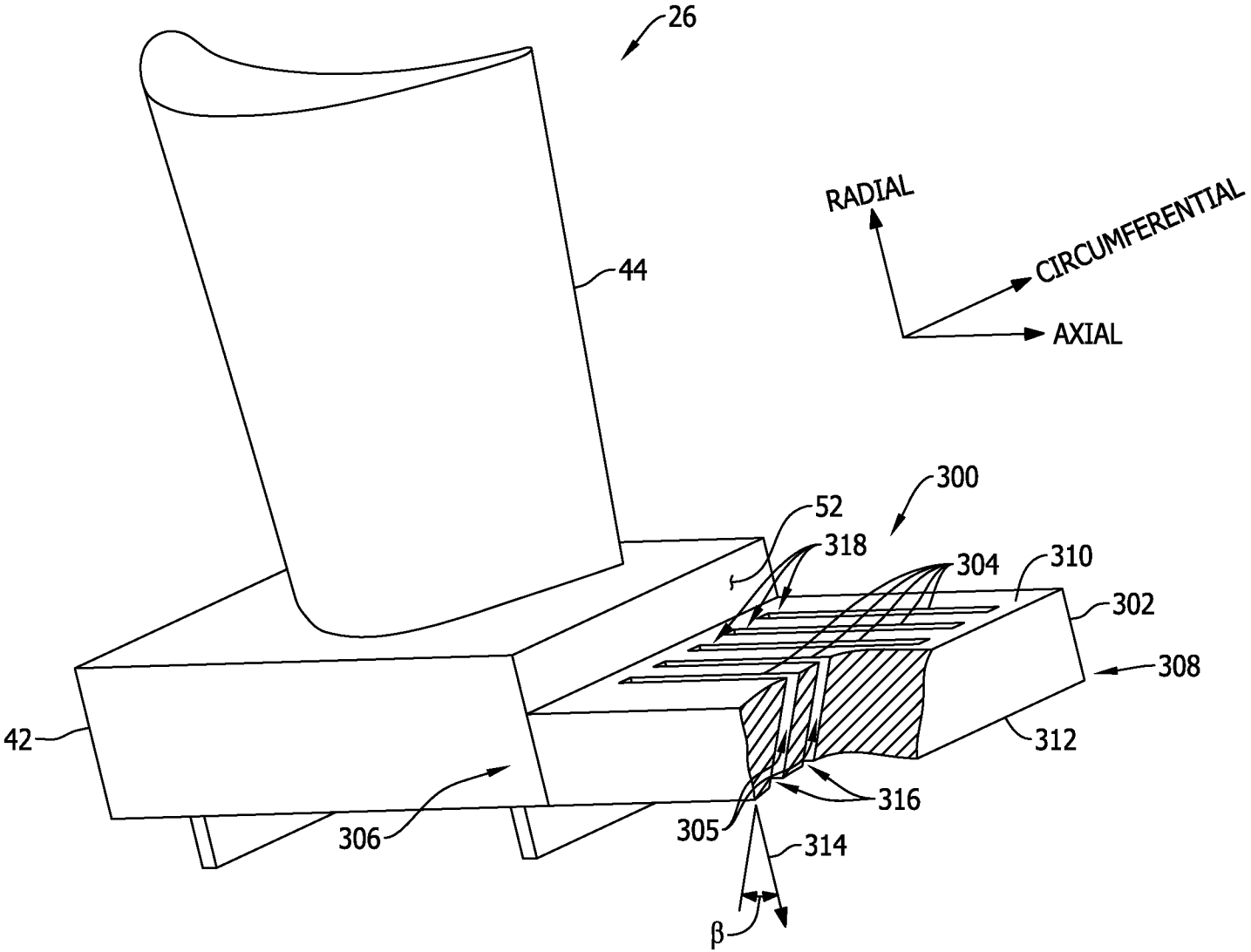
FIG. 4 is a schematic partial perspective view of an alternative leakage flow guide vane assembly coupled to the fixed blade shown in FIG. 2.

FIG. 4 is a schematic partial perspective view of an alternative radial leakage flow guide vane assembly 300 coupled to fixed blade 26. In the exemplary embodiment, radial leakage flow guide vane assembly 300 is shown with a portion in section. As illustrated, radial leakage flow guide vane assembly 300 includes a body 302 including a plurality of apertures or guide slots 304 defined therethrough that define passages 305. Body 302 is generally a rectangular-shaped prism extending substantially axially along centerline axis 32 of rotary machine 10. In particular, body 302 extends from a first end 306 to an opposite free second end 308. First end 306 is coupled to downstream end 52 of stationary portion 42. Body 302 is coupled to stationary portion 42 in any suitable fashion, such as, for example, and without limitation, via welding, brazing, bonding, and/or any other mechanical coupling process that facilitates coupling body 302 to stationary portion 42. Alternatively, body 302 may be integrally formed with stationary portion 42, such as, for example, via an additive manufacturing process or a machining process. In the exemplary embodiment, the plurality of guide slots 304 are circumferentially-spaced about rotor 16. The plurality of fixed blades 26 are positioned circumferentially adjacent each other such that stationary portions 42 cooperate to form a substantially continuous ring around rotor 16.

In the exemplary embodiment, each guide slot 304 is sized and shaped substantially identically. A respective guide slot 304 is formed as an aperture that extends substantially radially through body 302 from an outer surface 310 to an inner surface 312. In the exemplary embodiment, guide slots 304 are rectangular-shaped. Alternatively, guide slots 304 may be any shape that enables radial leakage flow guide vane assembly 300 to operate as described herein. For example, and without limitation, in one embodiment, guide slots 304 may have a cross-sectional shape that is generally circular, and in another embodiment, guide slots 304 may have a cross-sectional shape that is polygonal and forms a generally honeycomb-shaped array of guide slots 304.

In the exemplary embodiment, each respective guide slot 304 extends generally circumferentially at an angle β with respect to radial direction 314. Angle β has a value predetermined to ensure that steam 40 flowing through leakage flow path 48 exits leakage flow path 48 and returns to primary flow path 46 at a substantially similar tangential flow velocity as steam 40 passing through fixed blades 26.

In some embodiments, guide slots 304 circumferentially overlap such that a first portion 316 of a respective guide slot 304 is overlapped or covered in the radial direction by a second portion 318 of an adjacent guide slot 304. In an alternative embodiment, guide slots 304 may be circumferentially-spaced such that adjacent guide slots 304 do not overlap. In the exemplary embodiment, the number of guide vanes 202 and the angle β with which the guide slots 304 extend is predetermined based on specific operating parameters of rotary machine 10.

Figure 5:
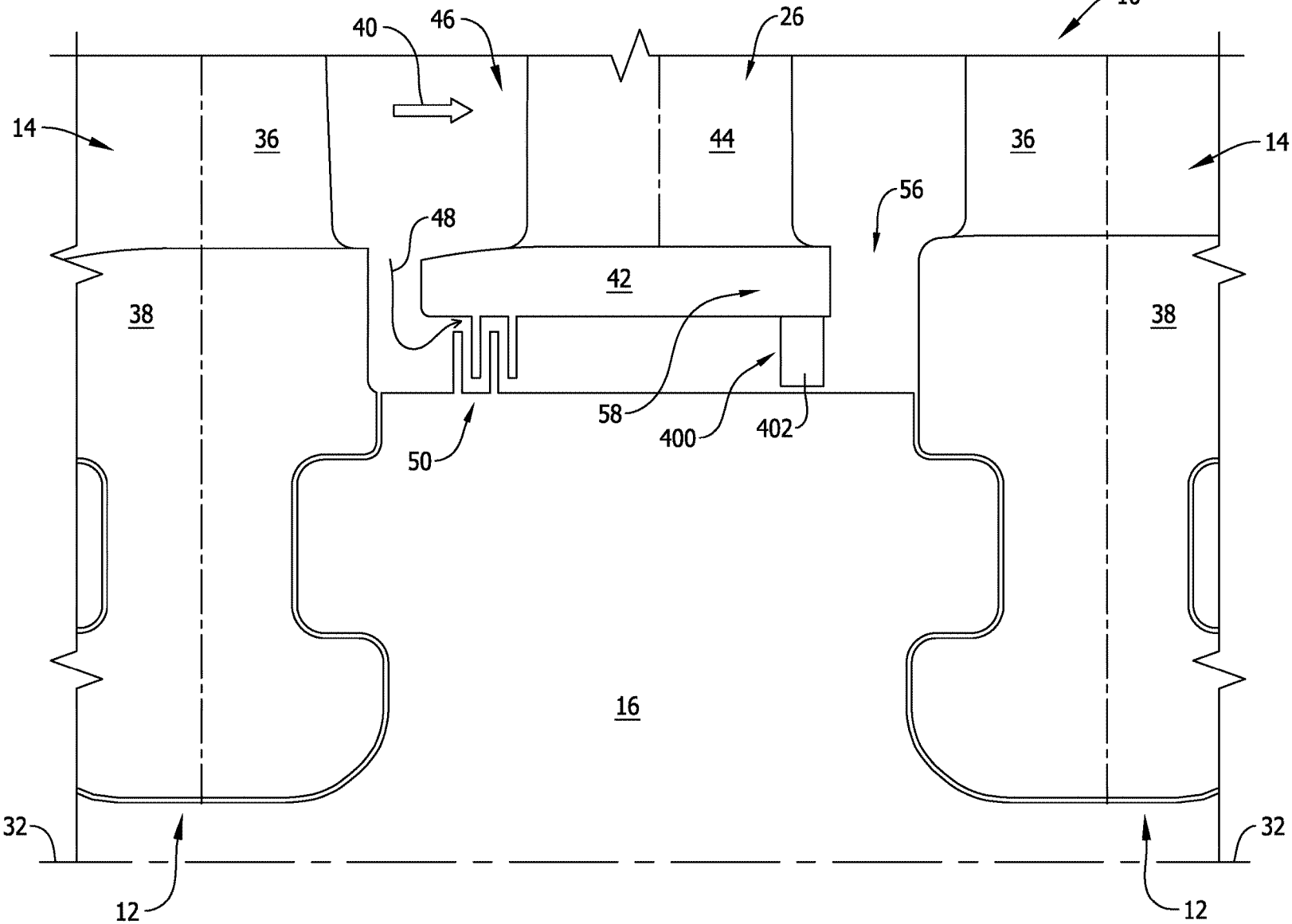
FIG. 5 is a schematic sectional view of an exemplary axial leakage flow guide vane assembly coupled to a fixed blade of the rotary machine shown in FIG. 1.
Figure 6:
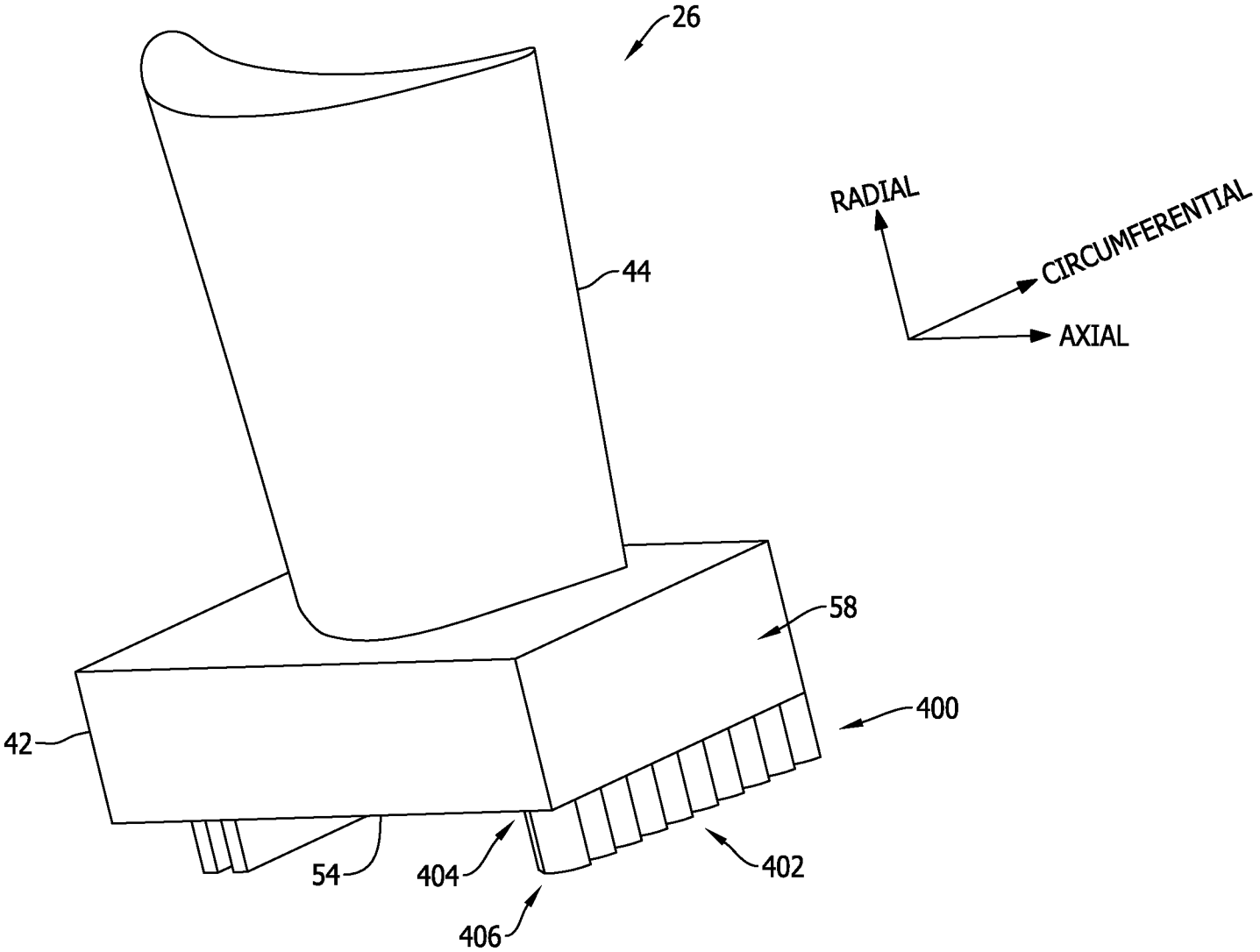
FIG. 6 is a schematic perspective view of the fixed blade shown in FIG. 5, and including the axial leakage flow guide vane assembly.
Figure 7:
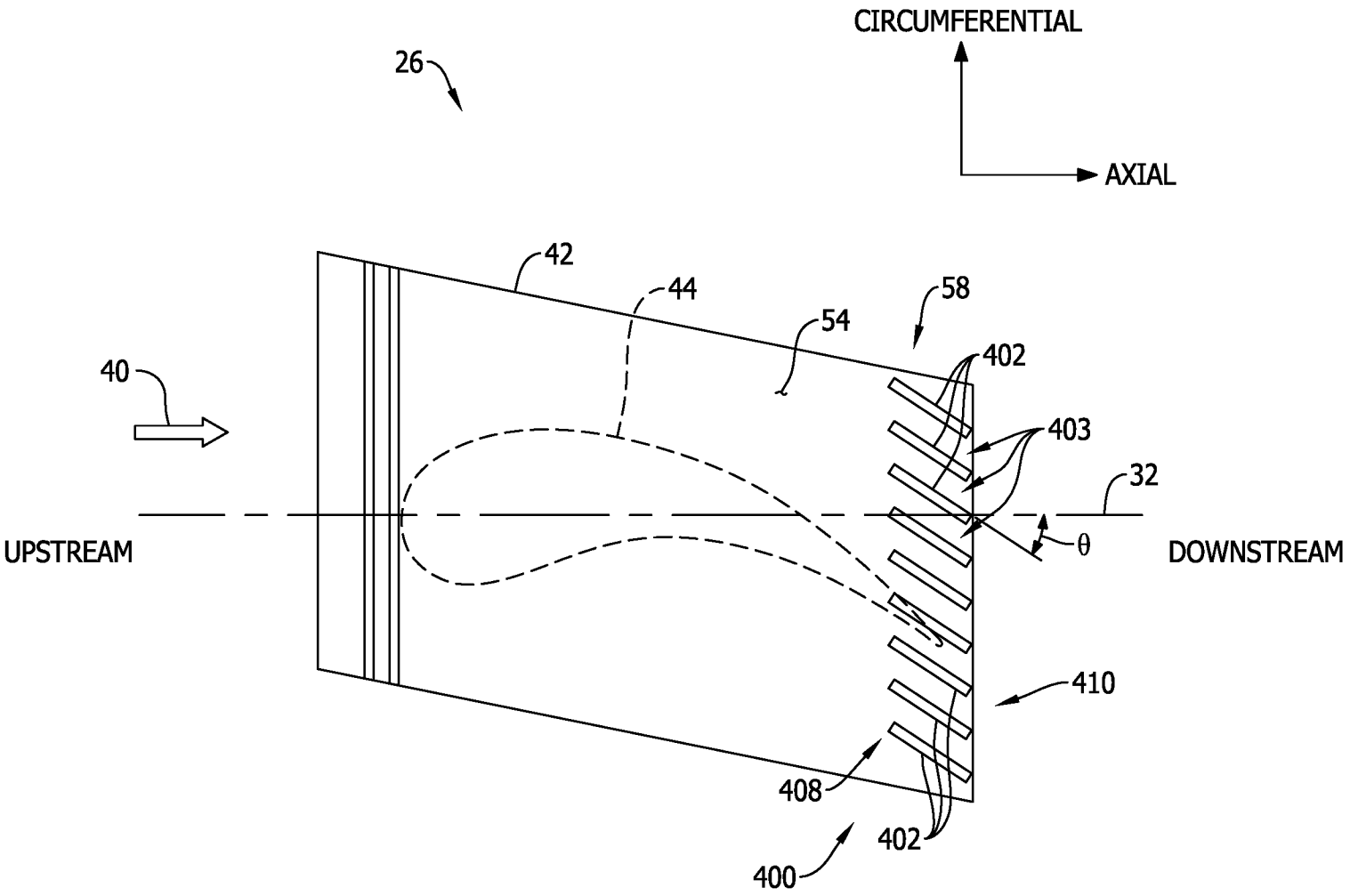
FIG. 7 is a schematic bottom view of the fixed blade shown in FIG. 5, and looking radially outward and including the axial leakage flow guide vane assembly.

FIG. 5 is a schematic sectional view of an exemplary embodiment of an axial leakage flow guide vane assembly 400 coupled to fixed blades 26. FIG. 6 is a schematic perspective view of fixed blade 26, including axial leakage flow guide vane assembly 400. FIG. 7 is a schematic bottom view of fixed blade 26 looking radially outward and including axial leakage flow guide vane assembly 400. In the exemplary embodiment, axial leakage flow guide vane assembly 400 includes a plurality of guide vanes 402 that extend substantially radially from bottom surface 54 of stationary portion 42 and are positioned along a rear portion 58 of stationary portion 42. The plurality of guide vanes 402 define a plurality of passages 403 therebetween. In particular, guide vanes 402 extend from a first end 404 to an opposite free second end 406. First end 404 is coupled to bottom surface 54 of stationary portion 42. Guide vanes 402 are coupled to stationary portion 42 in any suitable fashion, such as, for example, and without limitation, via welding, brazing, bonding, and/or any other mechanical coupling process that enables coupling guide vanes 402 to stationary portion 42. Alternatively, guide vanes 402 may be integrally formed with stationary portion 42, such as, for example, via an additive manufacturing process or a machining process. In the exemplary embodiment, the plurality of guide vanes 402 are circumferentially-spaced about rotor 16, such that the plurality of fixed blades 26 are positioned circumferentially adjacent each other such that stationary portions 42 cooperate to form a substantially continuous ring around rotor 16.

In the exemplary embodiment, each guide vane 402 is sized and shaped substantially identically. A respective guide vane 402 is formed as a thin plate and has a generally rectangular cross-sectional shape. Alternatively, guide vane 402 may have a non-rectangular cross-sectional shape, for example, and without limitation, an airfoil cross-sectional shape or any other cross-sectional shape that enables guide vane 402 to operate as described herein. In the exemplary embodiment, guide vane 402 is positioned at an angle θ with respect to centerline axis 32 of rotary machine 10, as best shown in FIG. 7. In the exemplary embodiment, angle θ has a value predetermined to ensure that steam 40 flowing through leakage flow path 48 exits leakage flow path 48 and returns to primary flow path 46 at a substantially similar tangential flow velocity as steam 40 passing through fixed blades 26.

In some embodiments, guide vanes 402 axially overlap such that an upstream or first portion 408 of a respective guide vane 402 overlaps or covers, in the axial direction, a downstream or second portion 210 of an adjacent guide vane 402 with respect to a flow of steam 40 through leakage flow path 48. In an alternative embodiment, guide vanes 402 may be circumferentially spaced such that adjacent guide vanes 402 do not overlap. In the exemplary embodiment, the number of guide vanes 402 and the angle θ with which guide vanes 402 are positioned is predetermined based on specific operating parameters of rotary machine 10.

In operation, high pressure steam 40 is channeled into primary flow path 46. Steam 40 pressurizes primary flow path 46 and induces rotation of rotor 16. In particular, steam 40 has a substantial axial velocity and impacts rotor blades 14 causing rotation of rotor 16. Moreover, steam 40 is channeled through fixed blades 26, which facilitate imparting a tangential or swirl velocity on the flow of steam 40. In the exemplary embodiment, the angle of airfoil 36 of rotor blade 14 and airfoil 44 of fixed blade 26 is predetermined to facilitate increasing the efficiency of rotary machine 10.

A portion of steam 40 flows from primary flow path 46 to leakage flow path 48. After leakage of steam 40 into leakage flow path 48, steam 40 is channeled towards guide vane assembly 400. Steam 40 passes through guide vane assembly 400 where it is channeled into gap 56 and primary flow path 46 with a swirl velocity substantially similar to steam 40 in primary flow path 46 and exiting from airfoil 44 of fixed blade 26. In particular, steam 40 in leakage flow path 48 enters passages 403 defined between guide vanes 402 in a substantially axially at first portion 408. Steam 40 flowing through guide vane assembly 400 is turned generally circumferentially by guide vanes 402 oriented at angle θ with respect to centerline axis 32. Steam 40 in leakage flow path 48 is channeled back to primary flow path 46 through gap 56. This facilitates inducing a swirl velocity to steam 40 exiting leakage flow path 48 and increasing an overall efficiency of rotary machine 10 by reducing the incidence loss of the steam leakage flow on a downstream rotor blade 14, thereby facilitating a decrease in associated fuel costs.

Figure 8:
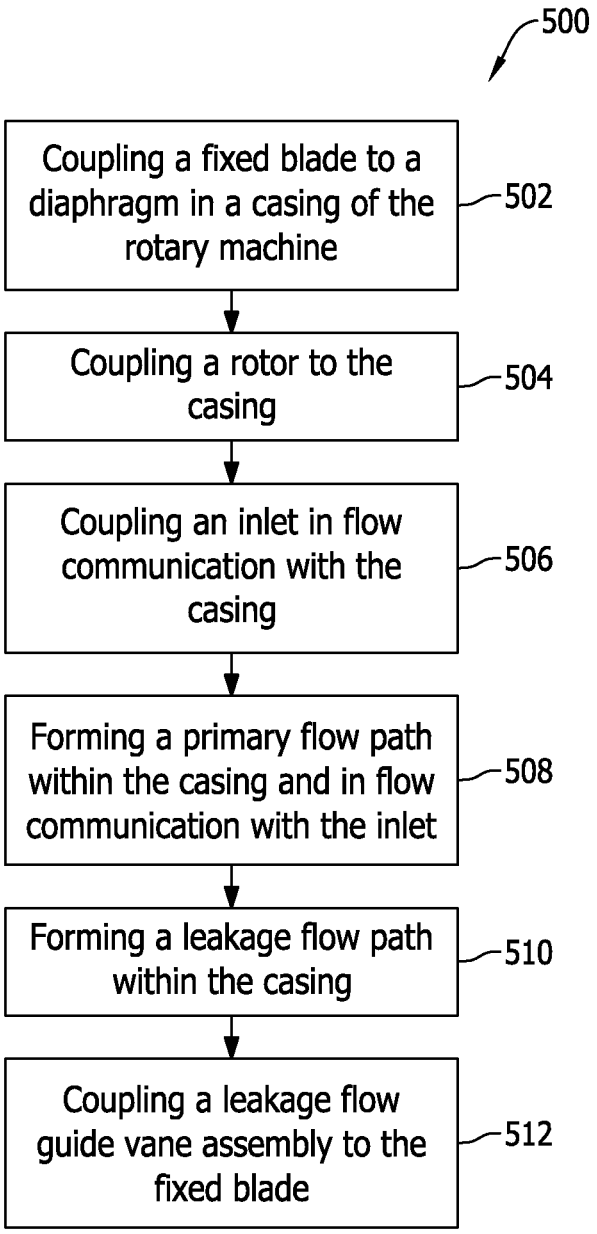
FIG. 8 is a flowchart of an exemplary method of assembling the rotary machine of FIG. 1.

An exemplary method 500 of assembling a rotary machine, such as rotary machine 10, is shown in the flow diagram of FIG. 8. With reference also to FIGS. 1-7, in the exemplary embodiment, method 500 includes coupling 502 a fixed blade 26 to a diaphragm, such as diaphragm 24, in a casing 22. Rotor 16 is coupled 504 to casing 22 and includes at least one turbine stage 12 located adjacent to and downstream form fixed blade 26. The at least one turbine stage 12 includes at least one rotor blade 14 coupled to rotor 16 for rotation therewith. In the exemplary embodiment, gap 56 is defined between fixed blade 26 and rotor blade 14. A steam inlet, for example steam inlet 28, is coupled 506 in flow communication to casing 22. Method 500 also includes forming 508 primary flow path 46 for steam 40 within casing 22 and in flow communication with steam inlet 28. Method 500 further includes forming a leakage flow path 48 for steam 40 within casing 22 and in flow communication with primary flow path 46. In particular, leakage flow path 48 is formed between stationary portion 42 of fixed blade 26 and rotor 16.

In the exemplary embodiment, method 500 also includes coupling 510 a leakage flow guide vane assembly, such as guide vanes assemblies 200, 300, and 400, to fixed blades 26 adjacent to downstream rotor blade 14. Each guide vane assembly includes, for example, a plurality of guide vanes 202 and 402, or guide slots 302, oriented to induce a tangential or swirl velocity substantially similar to steam 40 in primary flow path 46.

Exemplary embodiments of a fixed blade including a leakage flow guide vane assembly for a rotary machine, and methods of assembling the rotary machine, are described herein in detail. The embodiments include advantages over known rotary machines in that, when the rotary machine is operating, the present machine induces a tangential or swirl velocity to a steam leakage flow that is substantially similar to the tangential or swirl velocity of the flow of steam in the primary flow path. The fixed blades or nozzles of the rotary machine include a plurality of guide vanes or guide slots oriented to induce the tangential or swirl velocity to the leakage flow, such that when the leakage flow is channeled back into the primary flow path, the angle of incidence of the leakage flow is substantially similar to the primary steam flow at a leading edge of the rotor blades. The embodiments include further advantages in that the swirl velocity to the steam exiting the leakage flow path increases an overall efficiency of the rotary machine by reducing the incidence loss of the steam leakage flow on a downstream rotor blade, thereby facilitating decreasing the associated fuel costs.

The leakage flow guide vane assemblies and methods described above are not limited to the specific embodiments described herein, but rather, components of the apparatus and/or steps of the methods may be utilized independently and separately from other components and/or steps described herein. For example, the exemplary embodiments can be implemented and utilized in connection with many other rotary machines.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A blade comprising:

an airfoil configured to impart a flow velocity on a first portion of a working fluid;

a stationary portion comprising an upstream end, a downstream end, and a bottom surface extending axially between said upstream end and said downstream end, said stationary portion coupled to a radially inner end of said airfoil; and a leakage flow guide vane assembly coupled to said stationary portion, said leakage flow guide vane assembly comprising a body extending axially from said downstream end of said stationary portion to a free end and comprising a radially inner surface and a radially outer surface, said body defining a plurality of passages, said plurality of passages closed at said free end and extending through said body from said inner surface to said outer surface, said plurality of passages oriented to induce a swirl velocity to a second portion of a working fluid flowing through said passages to dispense the second portion of the working fluid at a substantially similar tangential flow velocity as the first portion of the working fluid passing over said airfoil.

2. A blade in accordance with claim 1, wherein said body extends axially from a first end coupled to said downstream end of said stationary portion to said free end.

3. A blade in accordance with claim 1, wherein said body is coupled to said stationary portion by at least one of a welding process, a brazing process, and a bonding process.

4. A blade in accordance with claim 1, wherein a first passage of said plurality of passages radially overlaps a second passage of said plurality of passages.

5. A blade in accordance with claim 1, wherein said plurality of passages extend through said body at a predetermined radial angle.

6. A rotary machine comprising:

a rotor; and a blade that extends circumferentially about said rotor, said blade comprising:

an airfoil;

a stationary portion comprising an upstream front face, a downstream back face, and a bottom surface extending axially between said front face and said back face, said stationary portion coupled to a radially inner end of said airfoil and defining a leakage flow path between said stationary portion and said rotor; and a leakage flow guide vane assembly coupled to said stationary portion and located in said leakage flow path, said leakage flow guide vane assembly comprising a plurality of passages defined therein, said plurality of passages oriented to induce a swirl velocity to a working fluid flowing through said passages, wherein said leakage flow guide vane assembly comprises a plurality of guide vanes extending axially downstream from a first end to an opposite, free second end, wherein said first end is coupled to said back face of said stationary portion, wherein said each guide vane comprises a first portion that extends radially outward from said bottom surface of said stationary portion to a predetermined distance from said bottom surface, and a second portion that extends circumferentially with respect to said first portion.

7. A rotary machine in accordance with claim 6, wherein said second portion of at least one of said guide vanes extends circumferentially at a predetermined angle with respect to said first portion of said at least one guide vane and overlaps said first portion of an adjacent guide vane in a radial direction.

8. A rotary machine in accordance with claim 6, wherein said each guide vane further comprises an arched portion coupled between said first portion and said second portion.

9. A method of assembling a rotary machine, said method comprising:

coupling a blade to a diaphragm of a casing of the rotary machine, the blade configured to impart a flow velocity on a first portion of a working fluid;

coupling a rotor to the casing, wherein the rotor includes at least one turbine stage located adjacent to and downstream from the blade;

forming a primary flow path within the casing and in flow communication with an inlet of the casing; and coupling a leakage flow guide vane assembly to the blade adjacent the at least one turbine stage, wherein the leakage flow guide vane assembly is positioned in a leakage flow path defined between the rotor and the blade, the leakage flow guide vane assembly including a body extending axially from the blade to a free end and having a radially inner surface and a radially outer surface, the body defining a plurality of passages, the plurality of passages being closed at the free end and extending through the body between the inner surface and the outer surface for inducing a swirl velocity in a second portion of a working fluid passing through the leakage flow path to dispense the second portion of the working fluid at a substantially similar tangential flow velocity as the first portion of the working fluid passing over the blade.

10. A method of assembling a rotary machine in accordance with claim 9 further comprising defining an axial gap between the blade and the at least one turbine stage.

11. A method of assembling a rotary machine in accordance with claim 9, wherein coupling the leakage flow guide vane assembly to the blade adjacent the at least one turbine stage comprises coupling the body to a stationary portion of the blade, the body extending into the leakage flow path.

* * * * *